US005397257A

United States Patent [19]

Bergeron

[11] Patent Number: 5,397,257

[45] Date of Patent: Mar. 14, 1995

[54] DRIVE EXTENDER FOR A STERN DRIVE UNIT AND SUCH A UNIT INCORPORATING THE EXTENDER

[75] Inventor: Robert M. Bergeron, Derry, N.H.

[73] Assignee: Land & Sea, Inc., North Salem, N.H.

[21] Appl. No.: 290,385

[22] Filed: Aug. 15, 1994

Related U.S. Application Data

[63] Continuation of Ser. No. 13,056, Feb. 3, 1993, abandoned.

[51] Int. Cl.[6] ..... B63H 21/26

[52] U.S. Cl. ..... 440/53; 248/644; 440/75; 440/112; 440/900

[58] Field of Search ..... 114/343, 364; 440/53, 440/75, 78, 83, 111, 112, 900; 248/200.1, 637, 640, 644; 403/23, 287, 341, 359

[56] References Cited

U.S. PATENT DOCUMENTS

| | | | |
|---|---|---|---|
| 3,865,068 | 2/1975 | Haasl | 440/900 |
| 3,888,203 | 6/1975 | Lohse | 440/112 |
| 4,545,559 | 10/1985 | Gilbreath | 248/642 |
| 4,676,756 | 6/1987 | Rodrigue | 440/900 |
| 5,088,946 | 2/1992 | Nakaama | 440/900 |

*Primary Examiner*—Robert J. Oberleitner
*Assistant Examiner*—Clifford T. Bartz
*Attorney, Agent, or Firm*—Davis, Bujold & Streck

[57] ABSTRACT

A kit, an assembly and the combination of these with a boat's stern drive unit for the purpose of extending the propeller rearwardly of the boat to increase the trim height adjustment range and leverage. The kit and the assembly include an extruded spacer and an extension shaft.

9 Claims, 4 Drawing Sheets

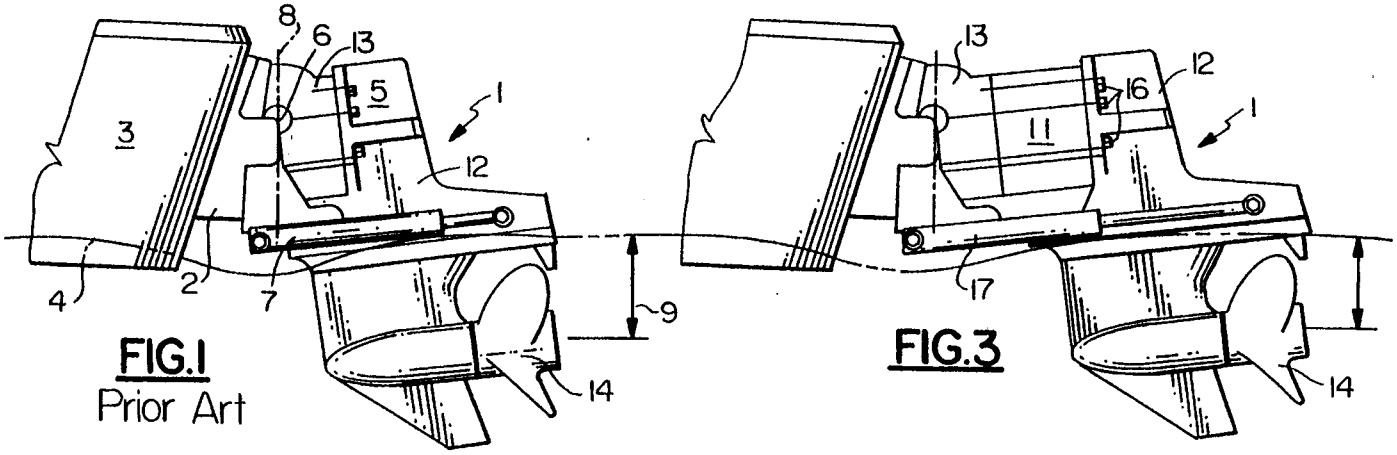
FIG.1
Prior Art
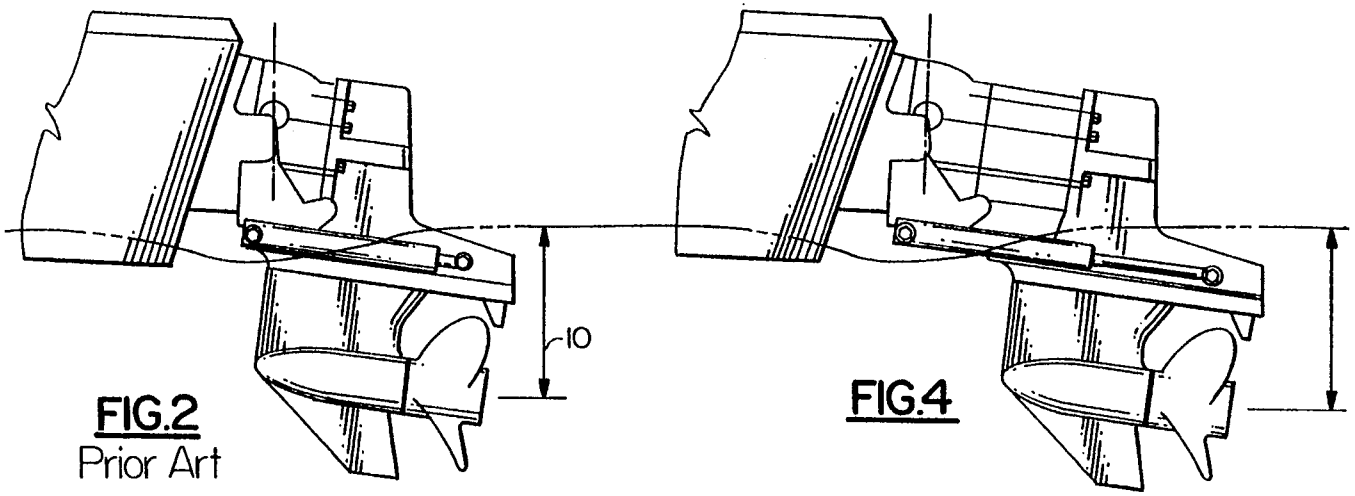
FIG.2
Prior Art
FIG.3
FIG.4

DRIVE EXTENDER FOR A STERN DRIVE UNIT AND SUCH A UNIT INCORPORATING THE EXTENDER

This is a continuation of copending application Ser. No. 08/013,056, filed on Feb. 3, 1993, now abandoned.

BACKGROUND OF THE INVENTION

The present invention relates to a drive shaft extender for a stern drive unit of a boat and to such a unit when the extender is incorporated therein.

Stern drive units for boats are units for use with inboard engines having drive shafts extending through the stern of a boat to the stern drive unit. The unit is mounted on the exterior of the stern above the water line and is arranged to drive a propeller using transmission arrangement not unlike that of an outboard motor. the stern drive unit incorporates pivot arrangements disposed adjacent the stern of a boat, to which the unit is mounted, to permit the pivotable portion of the unit to be pivoted about a substantially vertical axis for the purposes of steering the boat and to be pivoted about a substantially horizontal axis for the purpose of adjusting trim to optimize the performance of the boat under different operating conditions. Existing stern drive units are somewhat limited as to the amount of vertical travel over the range of trim angle adjustment with the result that the propeller cannot always be positioned at a desired depth in the water to optimize boat performance.

It is an object of the present invention to overcome the shortcomings of existing stern drive units.

It is a further object of the present invention to provide such an improvement in an economical, easy to assemble form.

SUMMARY OF THE INVENTION

According to the invention there is provided a stern drive unit extension kit for a stern drive unit, of a boat, in which a support structure is rigidly attached to the boat and supports a transmission structure by way of a pivot arrangement allowing adjustment of trim about a substantially horizontal axis and of steering angle about a substantially vertical axis while transmitting drive from an inboard engine to a propeller by way of the transmission structure, the transmission structure having two housing portions normally attached together with a drive shaft passing therethrough from the support structure to transmit said drive, the extension kit comprising a spacer configured to fit between the two housing portions and to be rigidly attached to both of the housing portions to increase the distance between the boat and the propeller and an extension shaft configured to extend through the spacer for connection between the drive shaft and the drive from the inboard engine.

The extender increases the moment arm between the boat's planing surface and the propeller thrust line (whenever the drive is tilted or steered so that its thrust line is not parallel to the centerline of the boat). It is standard practice to trim the drive out, to lift the bow of the boat for less hull frictional drag at high speed. A drive that has been extended by the present invention will trim the boat higher due to its added leverage and this results in a higher top speed. There is a point of diminishing return as setback is increased and setbacks of much over a foot are impractical from a performance and mechanical standpoint.

Because the extender extends the movable portion of the stern drive unit aft of the pivot point, it also increases the vertical distance that the gearcase and propeller swing through as the drive is trimmed (and less importantly the side to side distance as it is steered). This change in height with trim is very important as it reduces the propeller and gearcase drag when the unit is trimmed up for speed while decreasing prop slip when the drive is trimmed down for quick planing. The increase in vertical travel (over a typical 15 degree trim range) using the extender is about 3", which compares favorably with typical outboard jackplates.

Experimental extenders of the present invention have achieved a speed increase of about 10% on 60 MPH boats (more when a surfacing propeller is substituted to take advantage of the increased drive height and lower hull drag).

BRIEF DESCRIPTION OF THE DRAWINGS

The invention will now be described, by way of example, with reference to the accompanying drawings, in which:

FIGS. 1 and 2 illustrate a prior art stern drive unit shown attached to the stern of a boat and illustrating the prior art range of trim adjustment;

FIGS. 3 and 4 illustrates the stern drive unit of FIGS. 1 and 2 modified by the present invention to increase the range of trim height adjustment and leverage;

DETAILED DESCRIPTION OF THE PREFERRED EMBODIMENTS

Figure 5:
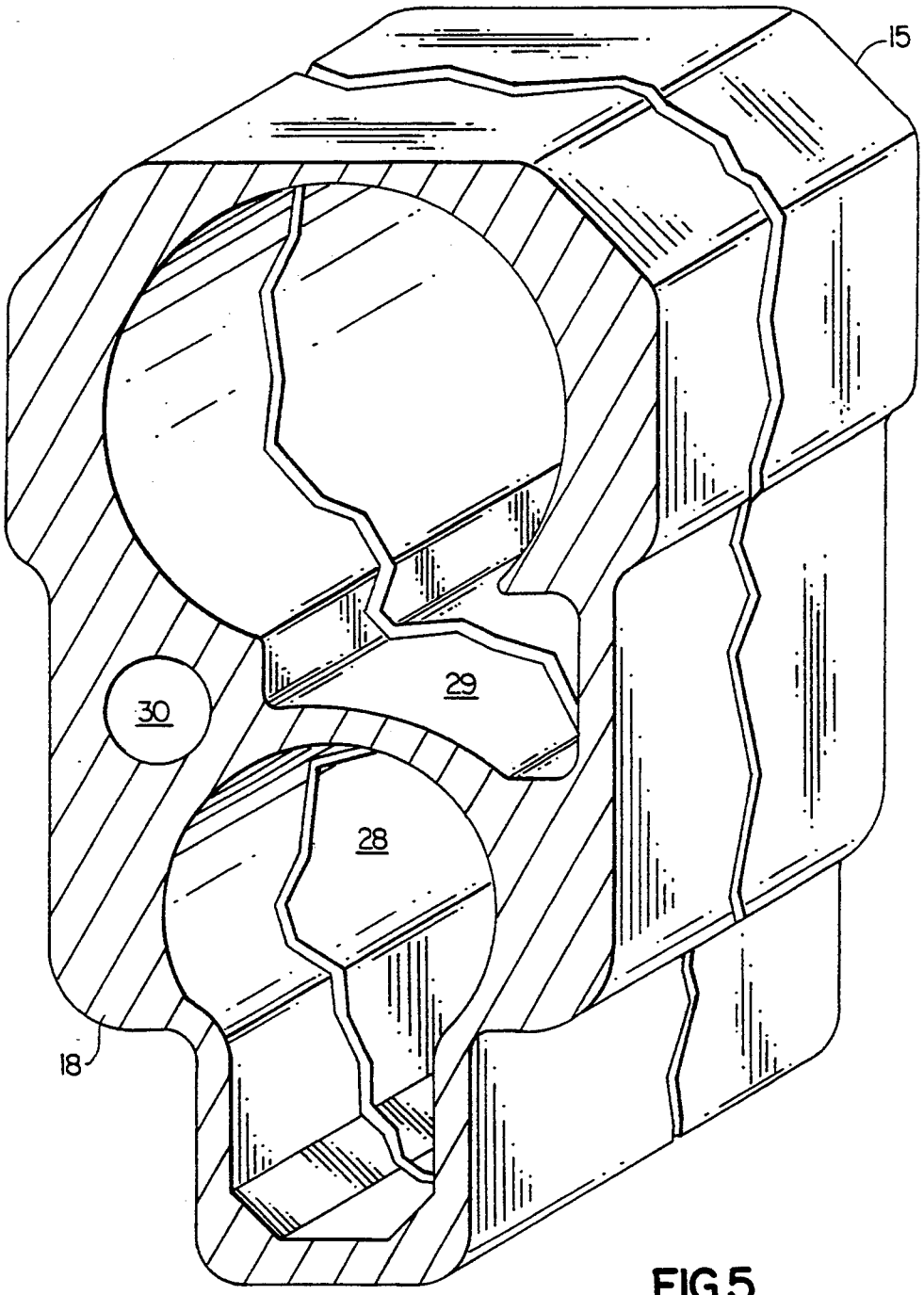
FIG. 5 is a cross-sectional view/perspective of an extrusion used in the present invention.

Referring first to FIGS. 1 and 2 a prior art stern drive unit 1 comprises a structure 2 fixedly attached to the stern of a boat 3 above the water line 4, drawn to represent the surface of water while the boat is in motion, and a movable transmission structure 5 mounted to the fixed structure 2 by a pivot structure 6 which provides for pivotal movement about a horizontal axis for adjustment of trim by means of a hydraulic actuator 7 interconnecting the fixed structure and the transmission structure. The pivot structure 6 also permits pivoting movement of the transmission structure about a vertical steering axis (by means not shown).

FIG. 1 shows the stern drive unit, fully trimmed out, with the propeller at its minimum distance below the water line 4 as shown by the arrowed dimension line 9 while FIG. 2 shows the stern drive unit, fully trimmed in, with the propeller at its greatest distance below the water line as shown by the arrowed dimension line 10. The prior art stern drive unit illustrated in FIGS. 1 and 2 has insufficient range of trim height adjustment to fully provide optimum trim of a boat under a full range of operating conditions.

The movable transmission structure 5 comprises interconnected housing portions 12 and 13 bolted together with joining faces substantially normal to the axis of a drive shaft extending from the fixed structure 2 into the movable transmission structure 5.

Referring now to FIGS. 3 and 4 the prior art stern drive unit 1 illustrated in FIGS. 1 and 2 is shown modified by a stern drive unit extender 11 rigidly mounted to space apart, by from about 3 inches to about 12 inches preferably 8 inches, the two housing portions 12 and 13 of the movable transmission structure 5 to place the propeller 14, 8 inches further away from the stern of the boat 3 than was the case in the prior art arrangement of FIGS. 1 and 2. The extender 11 comprises an extruded aluminum housing 15 which has been machined, drilled and assembled with other components in order to provide an extension of the drive from the fixed structure 2 to the transmission mechanism carried by housing portion 12 and to provide for rigid mounting of the portions 12 and 13 with the extender 11 therebetween, to form a rigid structure, by means of bolts or studs 16 which extend through a flange of portion 12 through the extender 11 into threaded holes already existing in portion 13. The appropriate gaskets are used between the connecting faces of the portions 12 and 13 and the extender 11 as those skilled in the art will be well aware. Because of the presence of the extender 11, the trim adjusting actuator 7 is replaced by a longer hydraulic actuator 17.

By virtue of the presence of the extender 11, the range of trim height adjustment leverage from the fully trimmed out position shown in FIG. 3 to the fully trimmed in position shown in FIG. 4 is significantly greater than the range the conventional stock unit illustrated in FIGS. 1 and 2 can provide with the result that optimum trim height and leverage can be provided over a greater range of boat operating conditions than is possible with the stock unit without increasing the range of trim angle adjustment. At the same time, the range of steering movement of the propeller is increased in the similar manner without increasing the range of steering angle adjustment.

Referring now to FIG. 5, the aluminum extrusion 15 used to form the housing of the extender 11 is shown with its end in cross-section and in semi-perspective form to illustrate that the extrusion in production is of indefinite length and of a constant cross-section. Thus, the cross-section 18 also represents the shape and form of both ends of the extrusion and the cross-section at any point along its length. The view from the reverse direction to that shown in FIG. 5 is a mirror image of FIG. 5.

Figure 6:
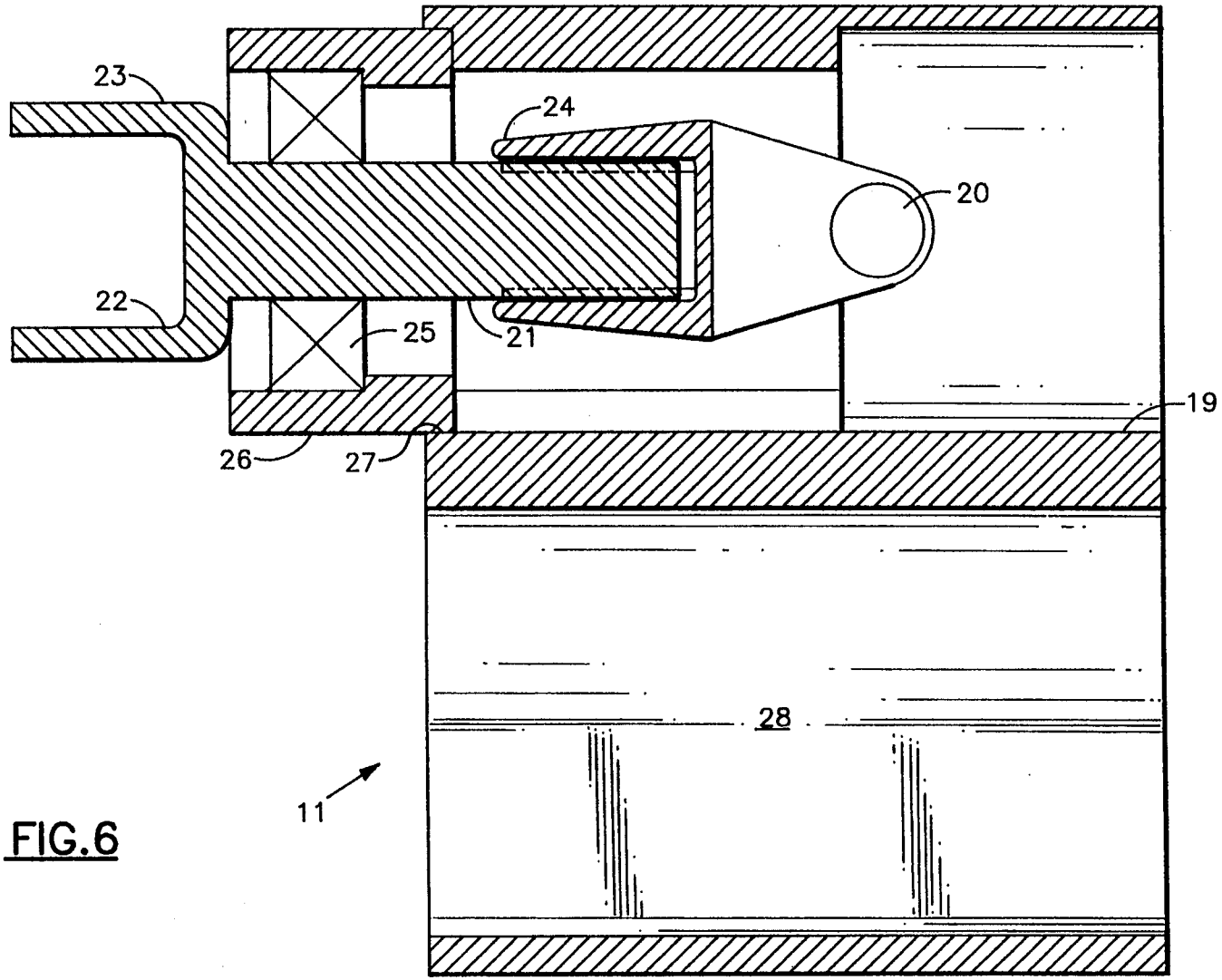
FIG. 6 is a longitudinal sectional elevation of the extender of the present invention utilizing the extrusion of FIG. 5.
Figure 7:
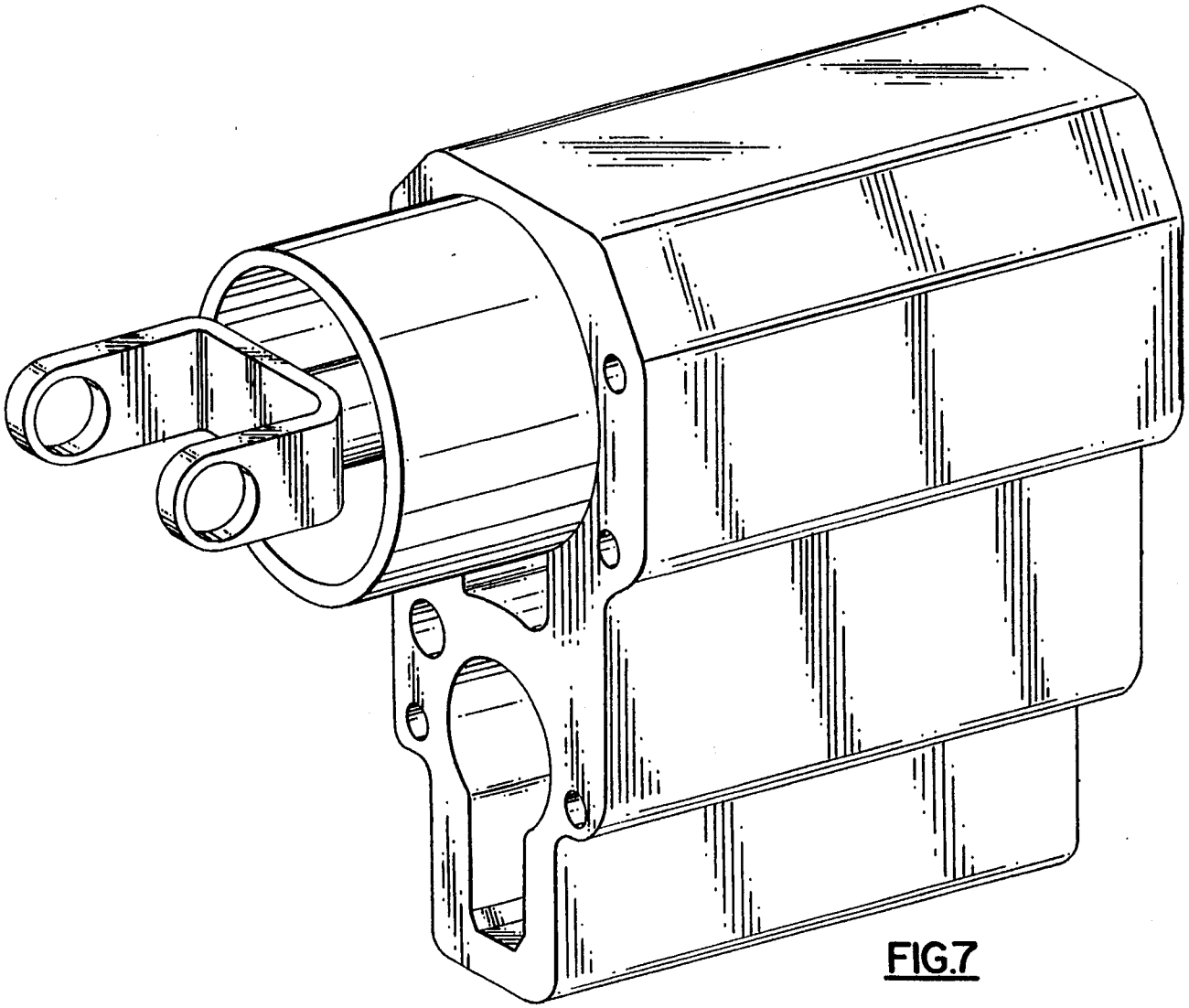
FIG. 7 is a perspective view of the extender.

Referring now to FIG. 6, the longitudinal cross-section of the extender 11 comprises an 8 inch length (other dimensions are, of course, possible and 8 inches is only given as an example) of the extrusion 15 machined to provide an annular recess 19 to accommodate the yoke portion of a universal joint which projects from the housing portion 12 toward the stern of the boat. In the prior art arrangement this yoke is connected with the yoke of a universal joint which is driven by the inboard engine to transmit power to the propeller while accommodating the aforementioned pivotal movement of the stern drive unit about the pivot structure. The yoke of the housing portion 12 is, upon assembly of the extender 11 to the stern drive unit, connected with yoke 20 of an extender drive shaft 21, the other end 22 of which forms a yoke 23, corresponding to the yoke of the housing portion 12, and arranged for connection to the yoke of the driven universal joint the fixed structure 2. The shaft 21 has a splined slip joint 24 to accommodate changes in the length of the shaft 21 during operation. The shaft 21 is supported by a ball or roller bearing 25 mounted in a bearing housing 26 which is fast with a further annular recess 27 machined in the extrusion remote from the annular recess 19. A further opening 28 extends longitudinally through the extender to provide for the passage of the exhaust gases. The extrusion is also provided with an opening 29 to accommodate transmission shift linkage and a passage 30 for water (see FIG. 5).

To assemble the extender to a stern drive unit such as that illustrated in FIGS. 1 and 2, the stern units transmission structure is separated at the interconnection between the housing portions 12 and 13 and the universal joint at the fixed structure is disassembled. The yoke 23 is then assembled to the portion of the universal joint remaining in the fixed structure 2 and the yoke 20 is assembled to the portion of the universal joint which projects from the housing portion 12. With the slip joint engaged, the extender housing is then bolted to and between the housing portions 12 and 13 to produce a rigid structure with the extender drive shaft therethrough. It will be appreciated the extensions of the shift linkage and the trim actuators are also installed during this process.

With an 8 inch extender used in a stern drive unit such as that shown in FIGS. 1 and 2, an increase of 3 inches in vertical swing of the propeller is achieved which permits a reduction in drag when the unit is fully trimmed out and which increases bite when the unit is fully trimmed in.

It is will be appreciated by those skilled in the art that the dimensions herein given are not limiting to the present invention and that the particular structure described could be changed by those skilled in the art without departing from the inventive concept. While the embodiment described utilizes an extender housing having parallel end faces, those skilled in the art will appreciate the extender housing could utilize non-parallel end faces in order to adjust the mean trim of the stern drive unit.

What is claimed is:

1. A stern drive unit incorporating an extension assembly, for the stern drive of a boat, having an inboard engine with an outboard stern drive, the stern drive comprising a support, incorporating a pivot arrangement, transmission structure attached to the support and connected to the engine through a drive shaft for transmitting power from the engine through the transmission to a propeller, the pivot arrangement on the support allowing adjustment of trim about a substantially horizontal axis and of steering angle about a substantially vertical axis during operation of the engine, the transmission structure and a portion of the support, which is pivotable about the pivot arrangement, together defining two interconnectable housing portions spaced apart by the extension assembly which comprises:

(a) a spacer defining a longitudinal axis, said spacer being sized and configured to fit between the two housing portions and being rigidly attached to both of the housing portions to increase the distance between the boat and the propeller a desired distance from that existing when the housing portions are interconnected; and, (b) an extension drive shaft installed in an opening through said spacer along said axis connected with the transmission to the propeller and inboard engine at the pivot of the support.

2. The stern drive unit according to claim 1 wherein a bearing is located in said spacer, said extension drive shaft being supported by said bearing.

3. The stern drive unit assembly according to claim 2 wherein said extension assembly further comprises a hydraulic actuator connected at each end to both said housing portions and being of a sufficient length to traverse said spacer.

4. The stern drive unit assembly according to claim 3 wherein said spacer is rigidly attached to the two housing portions by means of bolts which extend through said spacer substantially parallel to said axis and into both said housing portions.

5. The stern drive unit assembly according to claim 4 wherein said spacer has an annular recess substantially parallel to said axis to accommodate a yoke of a universal joint which projects from one of said housing portion.

6. The stern drive unit assembly according to claim 5 wherein said spacer has a plurality of longitudinal openings extending therethrough to provide passageways for a transmission control linkage, water and exhaust gases.

7. The stern drive unit assembly according to claim 6 wherein said extension drive shaft comprises two ends, a yoke fixedly attached to each said ends, and a splined joint located between said ends.

8. The stern drive unit assembly according to claim 7 wherein said spacer has a length which increases trim height, leverage and steering movement of the boat.

9. The stern drive unit assembly according to claim 8 wherein said length is chosen from a range of 3 inches to 8 inches.

* * * * *